US007303101B2

(12) United States Patent
Goldman

(10) Patent No.: US 7,303,101 B2
(45) Date of Patent: Dec. 4, 2007

(54) TOP SIZER CLIP FOR GARMENT HANGER

(75) Inventor: Stuart Goldman, Wayne, NJ (US)

(73) Assignee: Uniplast Industries, Inc., Hasbrouck Heights, NJ (US)

( * ) Notice: Subject to any disclaimer, the term of this patent is extended or adjusted under 35 U.S.C. 154(b) by 27 days.

(21) Appl. No.: 11/321,728

(22) Filed: Dec. 28, 2005

(65) Prior Publication Data

US 2007/0145084 A1 Jun. 28, 2007

(51) Int. Cl.
*A41D 27/22* (2006.01)

(52) U.S. Cl. ..... 223/85; 40/322

(58) Field of Classification Search ..... 223/85, 223/88; 40/322; D6/315, 328
See application file for complete search history.

(56) References Cited

U.S. PATENT DOCUMENTS 4,322,902 A * 4/1982 Lenthall ..... 40/322
4,881,836 A * 11/1989 Blanchard ..... 40/322
D332,180 S * 1/1993 Marshall et al. ..... D6/328
5,377,884 A * 1/1995 Zuckerman ..... 223/85
5,388,354 A 2/1995 Marshall et al.
5,503,310 A * 4/1996 Zuckerman et al. ..... 223/85
5,628,132 A 5/1997 Marshall et al.
5,775,553 A 7/1998 Marshall et al.
5,794,363 A 8/1998 Marshall et al.
5,857,276 A 1/1999 Marshall et al.
5,884,422 A 3/1999 Marshall et al.
6,726,067 B2 4/2004 Louw et al.
D510,198 S * 10/2005 Willardson ..... D6/328
D528,807 S * 9/2006 Mainetti ..... D6/328
2006/0006204 A1* 1/2006 Mainetti ..... 223/85
2006/0213938 A1* 9/2006 Gouldson ..... 223/85

OTHER PUBLICATIONS

U.S. Appl. No. 11/421,003, Goldman.
U.S. Appl. No. 29/245,826, Goldman.
U.S. Appl. No. 29/262,968, Goldman.

* cited by examiner

*Primary Examiner*—Gary L. Welch
*Assistant Examiner*—Nathan E Durham
(74) *Attorney, Agent, or Firm*—Darby & Darby P.C.

(57) ABSTRACT

A top sizer clip for use with a garment hanger includes a body having a pair of side walls and end walls joined to and extending between the side walls. An outer surface of each of the side walls has a concave shape and the body includes a top wall that is joined to upper edges of the side walls and end walls, with the top wall partially enclosing the body so as to create a hollow structure that includes an interior compartment defined by the end walls, side walls, and top wall. The top wall has an opening formed therein to provide an entrance into the interior compartment and is constructed for receiving a hook member of the hanger.

25 Claims, 4 Drawing Sheets

TOP SIZER CLIP FOR GARMENT HANGER

TECHNICAL FIELD

The present invention relates to a garment hanger of the type which includes a locking information clip and more particularly, to a top sizer clip for use with a garment hanger and one which is adapted to fit on most hangers/hook members.

BACKGROUND

There are a number of different types of garment hangers that are used to hold a number of different articles of clothing or other types of articles, such as linens or other household fabrics. Typically, garment hangers are either formed of a plastic material or a metal material or a combination thereof. Not only do garment hangers come in a variety of different sizes but they also come in a number of different styles that have different types of construction to accommodate different articles which are carried by the hangers.

For example, one type of garment hanger construction is designed to secure knitwear, blouses, slips, strapped garments, including dresses and lingerie. Another type of garment hanger construction is designed to also secure blouses, dresses and other light garments, while another type of garment hanger is designed to secure heavier knitwear, blouses, pants and light weight pant suits. Yet another type of garment hanger is designed to secure coats, jackets and outerwear. The foregoing types of garment hangers can be generally classified as being top garment hangers, while another class of garment hangers is pant hangers, which are those hangers that are designed to secure pants, skirts, and other outfits together. Often times, pant hangers incorporate some type of clamp mechanism to securely grasp and hold the articles of clothing. One will appreciate that there are even more types of garment hangers (e.g., bra/panty hanger) that are intended for particular applications.

One accessory that is often used with a hanger is a size indicator that typically is a small plastic part that attaches to the body of the hanger and has indicia formed thereon that indicates the size or some other identifying mark of the article of clothing that is being held on the hanger. The size indicator can either take the form of a side sizer, where the clip (sizer) attached to the side of a hook member or a top sizer, where the clip attaches more to the top of the hook member.

Conventional top sizer clips are most times custom designed for a specific type or style of hanger (i.e., a matching hanger) and therefore, when they are used with other hangers, the clips tend not to be secured to the hanger but instead either are too small so that they can not be received on the base structure or they are too large and therefore, they wobble on the base structure and can easily become disengaged and fall off the hanger. By not having a secure attachment between the clip and the hanger, the size indicators do not perform their full intended function and instead can easily become misplaced and replacement thereof can result in the wrong size indicator being placed on the hanger which in turn can result in the wrong article of clothing being selected by a consumer or if no size indicator is present, the consumer may rummage through the clothing and leave an untidy display in order to find the proper size.

SUMMARY

A top sizer clip for use with a garment hanger includes a body having a pair of side walls and end walls joined to and extending between the side walls. An outer surface of each of the side walls has a concave shape and the body includes a top wall that is joined to upper edges of the side walls and end walls, with the top wall partially enclosing the body so as to create a hollow structure that includes an interior compartment defined by the end walls, side walls, and top wall. The top wall has an opening formed therein to provide an entrance into the interior compartment and is constructed for receiving a hook member of the hanger.

An inner surface of at least one of the first and second side walls includes a friction enhancing feature in the form of a plurality of ribs that are vertically orientated along the inner surface of the side wall and axially aligned with the opening formed in the top wall. The ribs serve several functions that are associated with the action of securing the top sizer clip to the hanger, and in particular, to a base section thereof. First, the ribs create friction so that the top sizer clip stays on tight and second, the ribs also prevent the sizer clip from moving side to side as well.

The opening formed in the top wall includes features that are formed as a part thereof, e.g., formed along end edges that define the opening, and promote flexing/stretching of the body so that the top sizer clip can fit over even thicker hangers/hook holders (hook member). More specifically, the notches introduce weak points in the top wall of the top sizer clip and permit the wall structures of the top sizer clip to flex as the base structure is inserted into the interior and causes the side walls to flex outwardly.

The top sizer clip of the present invention is constructed to be used with and securely attached to any number of different types of hangers regardless of whether the hangers include thicker or thinner hook members.

Other features and advantages of the present invention will be apparent from the following detailed description when read in conjunction with the accompanying drawings.

BRIEF DESCRIPTION OF THE DRAWINGS FIGURES

The foregoing and other features of the present invention will be more readily apparent from the following detailed description and drawings figures of illustrative embodiments of the invention in which.

DETAILED DESCRIPTION OF PREFERRED EMBODIMENTS

Figure 1:
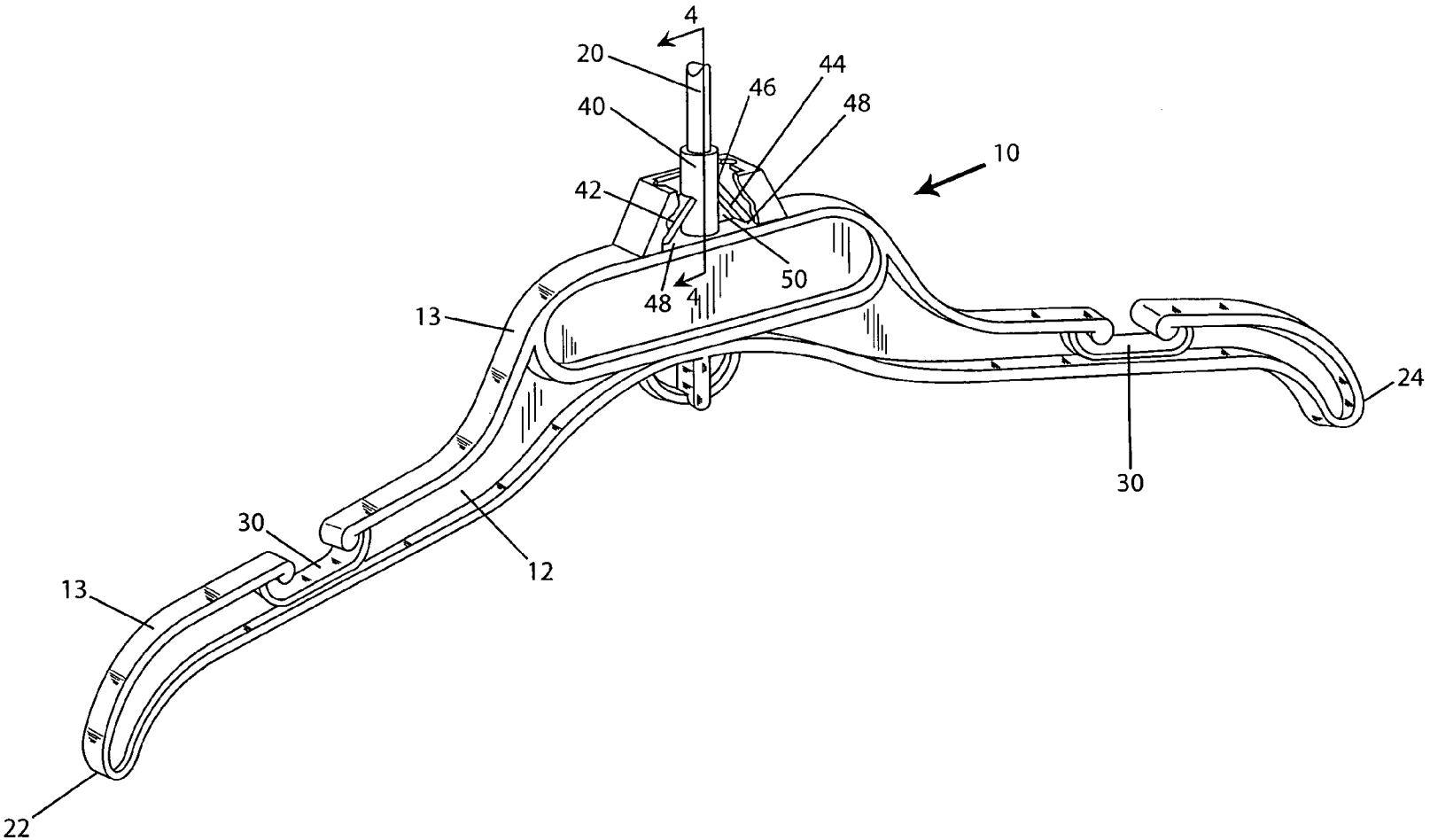
FIG. 1 is a perspective view, partially broken away, of a conventional garment hanger with a top sizer clip according to the present invention attached thereto.
Figure 2:
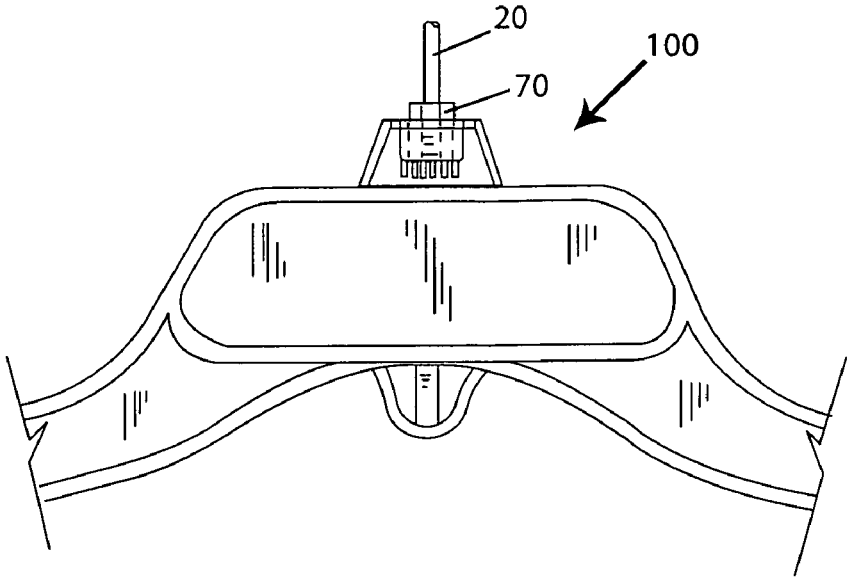
FIG. 2 is a partial side elevation of the hanger and top sizer clip of FIG. 1 being attached to a hook holder of the hanger.
Figure 3:
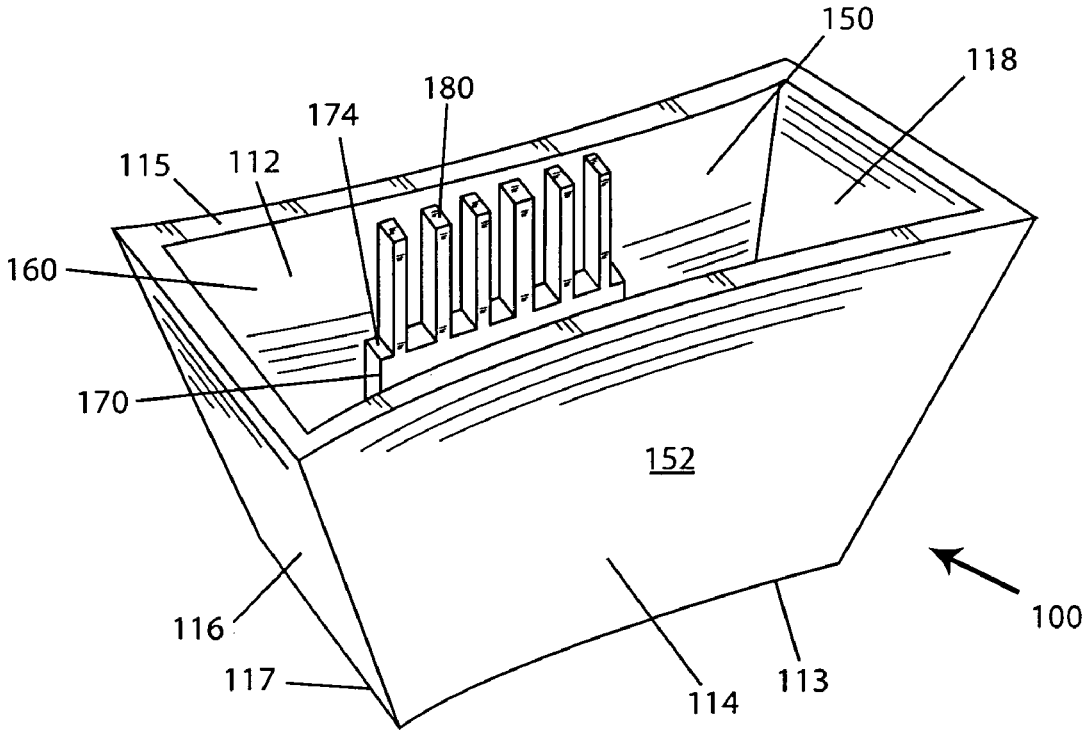
FIG. 3 is a bottom perspective view of the top sizer clip according to the present invention.

FIG. 1 is a perspective view, partially broken away, of a conventional garment hanger 10 that includes a body portion 12 (cross bar) having two opposing ends 22, 24 and a hook member 20 that is attached to the body portion 12. A top sizer clip (indicator) 100 according to the present invention is shown attached to the hook member 30. The exemplary garment hanger 10 is of the type that includes a clamp or grip assembly 30 formed near or at each of the first and second ends 22, 24. The grip assemblies 30 are integrally formed with body portion 12 at the first and second ends 22, 24. The article of clothing is placed within the grip assembly 30. FIG. 2 is a side elevation view of the hanger 10 with the top sizer clip indicator 100 being attached thereto. It will be appreciated that the top sizer clip indicator 100 can be formed of either an opaque material or transparent material, etc.

It will be appreciated that this type of grip assembly 30 is merely one exemplary type and that a number of other types of grip assemblies 30 can be used.

The body portion 12, including the grip assemblies 30, is preferably made as a single piece, molded in plastic using a plastic injection molding machine, as understood by those skilled in the art. Any appropriate plastic can be used, such as styrene, which provides a clear, virtually transparent hanger and alternatively, the hanger 10 can be molded using polypropylene, such as H.I. styrene polypropylene, polypropylene, polyvinylchloride, ABS or other suitable thermoplastics and/or mixtures thereof. As understood by those skilled in the art, the plastic mixture used to mold the hangers can include additional resins for added strength and reinforcement.

The illustrated garment hanger 10 is of a swivel hook type construction in that the hook member 20 is swivably or pivotally attached to the body portion 12 at a location that is generally at a midpoint along the body portion 12. The hook member 20 is pivotally received within a bore that is formed in a base structure 40 that is integrally attached at one end to an upper edge 13 of the body portion 12. The bore therefore has a complementary shape as the hook member 20 and thus, for the illustrated embodiment, the bore is annular in shape to complement the circular shape of the hook member 20. The overall shape of the base structure 40 is not critical and it can assume any number of different shapes. For example, while the illustrated base structure 40 has a circular cross-section, it will be appreciated that the base structure 40 can have a number of different shapes, such as rectangular or square, oblong, etc. The hook member 20 is thus frictionally fit within the bore; however, it is permitted to swivel freely therein when a user applied a force to the hook member 20 to produce such movement.

According to the present invention, the base structure 40 includes first and second side elements 42, 44 that extend outwardly therefrom and are integral with the body portion 12. More specifically, each of the first and second side elements 42, 44 has a first end 46 that is integrally connected to the base structure 40 and an opposing second end 48 that is integrally connected to the upper edge 13 of the body portion 12. While, the precise connection points between the first ends 46 and the base structure 40 and the second ends 48 and the body portion 12 can vary, it is important that a space 50 of sufficient size is formed between each of the first and second side elements 42, 44 and the base structure 40 and upper edge 13.

In the illustrated embodiment, the first and second side elements 42, 44 are elongated, planar walls that extend from the upper edge 13 to an upper end of the base structure 40. The width of the first and second side elements 42, 44 and the base structure 40 is preferably the same or about the same. An angle is thus formed between each of the first and second side elements 42, 44 and the upper edge 13. In this embodiment, the space 50 is generally triangular shaped. The first and second elements 42, 44 do not have to have a linear, planar construction, as it will be appreciated that the first and second side elements 42, 44 can have an arcuate shape. In other words, the first and second side elements 42, 44 can have a curved surface resulting in space 50 having an irregular space.

FIGS. 3-9 illustrate the top sizer clip 100 according to one embodiment of the present invention. The top sizer clip 100 is formed of a clip body 110 that is essentially hollow and is defined by a first side wall 112, an opposing second side wall 114, a first end wall 116, an opposing second end wall 118, and a top wall 120. The bottom of the top sizer clip 100 is open so as to permit the top sizer clip 100 to be inserted over the hook member 20 and then securely attached to the hanger 10 as described below.

While the top sizer clip 100 can be formed of any number of different materials, the clip 100 is typically made from a plastic material using conventional techniques, such as molding techniques, e.g., injection molding. The clip 100 can be either opaque in nature or semi-transparent or transparent and can be formed to have any number of different colors.

Figure 4:
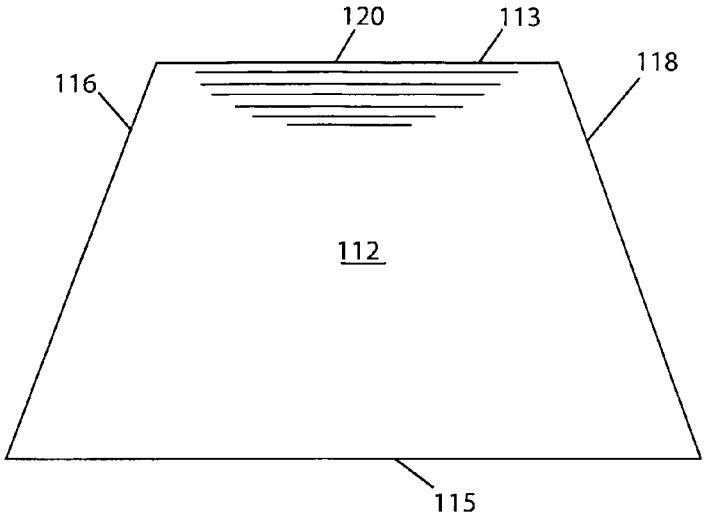
FIG. 4 is a front elevation view of the top sizer clip of FIG. 3.
Figure 5:
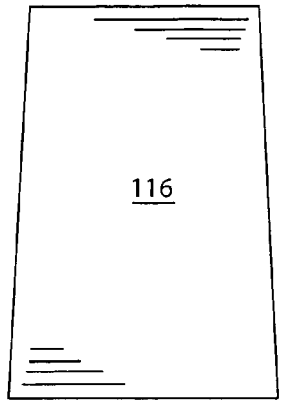
FIG. 5 is a right side view (end view) of the top sizer clip of FIG. 3.
Figure 6:
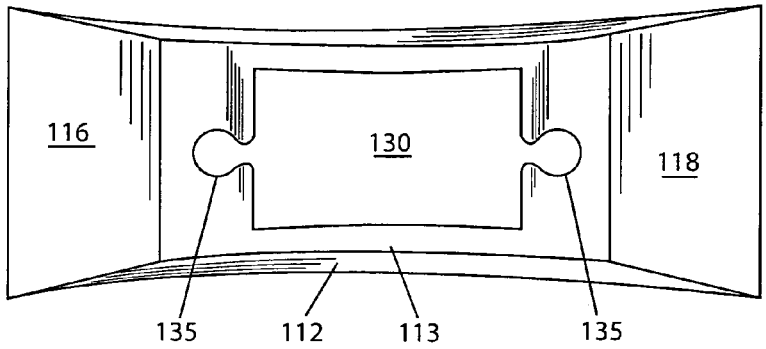
FIG. 6 is a top plan view of top sizer clip of FIG. 3.
Figure 7:
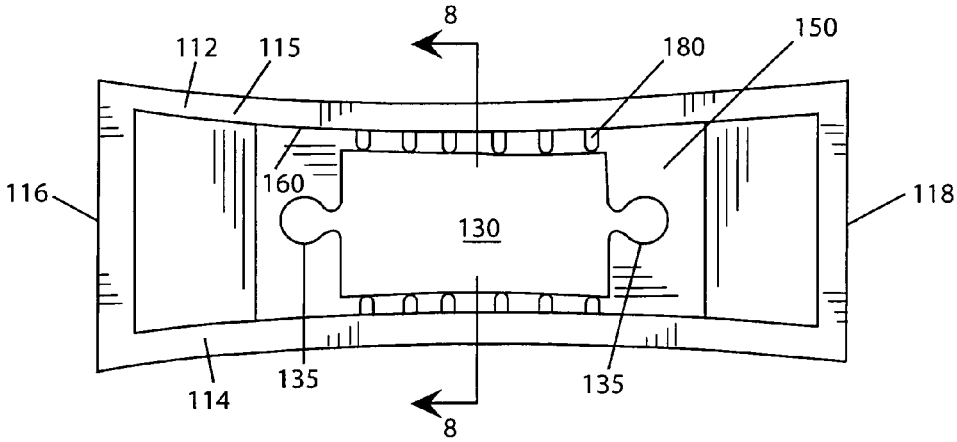
FIG. 7 is a bottom plan view of the top sizer clip of FIG. 3.
Figure 8:
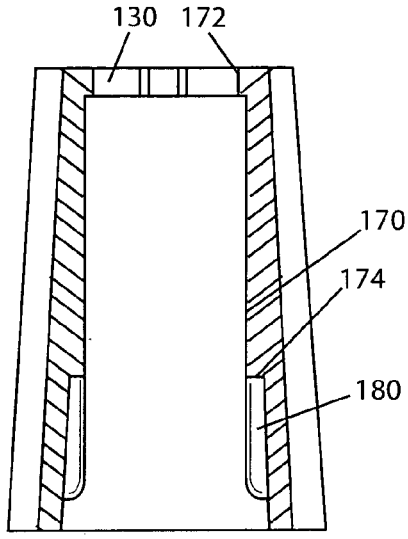
FIG. 8 is a cross-sectional view taken along the line 8-8 of FIG. 7.
Figure 9:
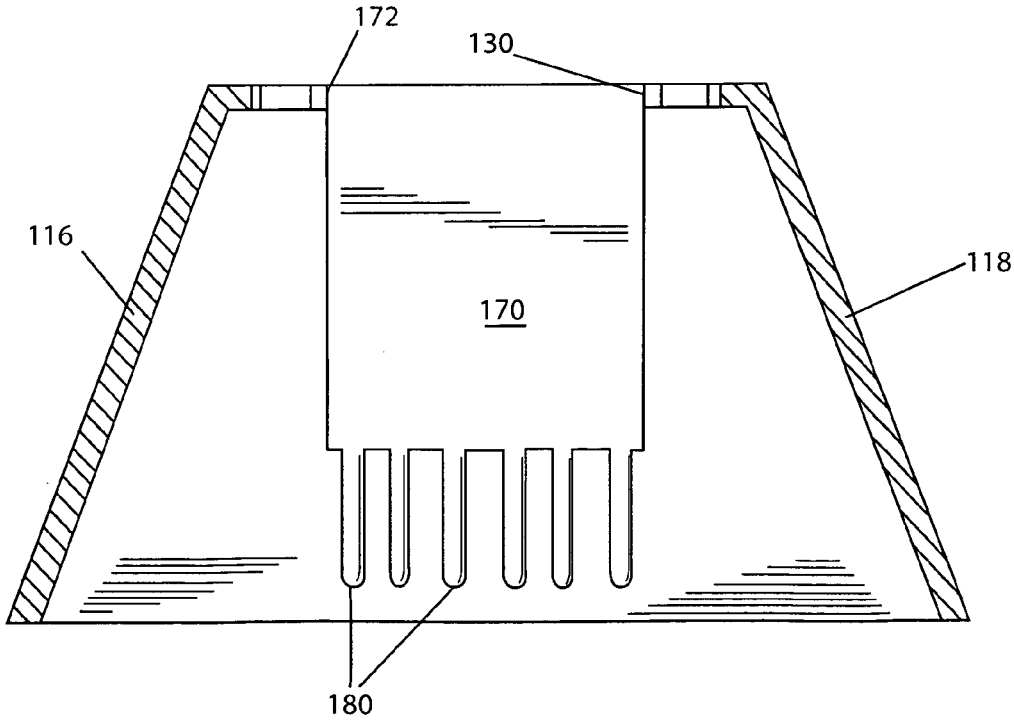
FIG. 9 is another cross-sectional view of the top sizer clip FIG. 3.

As best shown in FIGS. 4 and 6, each of the first and second side walls 112, 114 have a substantially parallelogram shape in that top and bottom edges 113, 115, respectively, thereof are parallel and the two end walls 116, 118 join the side walls 112, 114 at an angle such that the ends are beveled walls with respect to a ground surface (bottom edge 115). The end walls 116, 118 extend between the two side walls 112, 114 and are joined at their top edges 117 to the top wall 120. The end walls 116, 118 can have any number of different shapes; however, the walls 116, 118 typically have either a square or rectangular shape.

The top wall 120 is joined along its peripheral edge to the side walls 112, 114 and the end walls 116, 118. The top wall 120 includes an opening 130 that is formed therethrough and provides an entrance into an interior 140 of the top sizer clip 100. The opening 130 has a predetermined shape and includes a pair of features 135 that are formed in the top wall 120 and communicate with and are associated with the opening 130. More specifically, the features 135 are in the form of notches or slots that are formed along end edges 132 that define the opening 130. For example, each of the features 135 has a circular or arcuate shape. As best shown in FIG. 6, the notches 135 are formed in the same locations of the respective edges 132. For example, the notches 135 are formed in the central sections or regions of the edges 132.

The opening 130 has a width, W, and a length, L, as illustrated best in FIG. 6.

The body 110 of the top sizer clip 100 has an inner surface 150 and an opposing outer surface 152. The inner surface 150 of the clip 100 is partially defined by an inner face 160 formed as part of each side wall 112, 114. Each inner face 160 of each side wall 112, 114 includes one or more attachment features that facilitate the secure attachment of the top sizer clip 100 to the hanger 10, and more particularly, to the hook member 20. One of these attachment features is in the form of a ramp like structure 170 that is formed along the inner surface 150 and protrudes or extends above the surrounding sections of the inner surface 150. The ramp 170 extends from a top edge 172 that coincides with the top edge of the side wall 112, 114 and terminates with a ramp edge (bottom edge) 174 that is spaced a predetermined distance from the bottom edge thereof.

While the shape and size of the ramp 170 can vary, the dimensions of the ramp 170 are preferably complementary to the dimensions of the opening 130. More specifically, a width of the ramp 170 or at least the top edge thereof is preferably approximately equal to the width, W, of the opening 130. This permits alignment between the opening 130 and the ramp 170. The ramp 170 can have any number of different shapes, with one shape being a substantially square or rectangular shape, as illustrated. However, the width of the ramp 170 can vary along its length so as to provide a tapered appearance. For example, the bottom ramp edge 174 can have a width that is slightly less than the width of the top edge 172. It will also be appreciated that the thickness of the ramp 170 can vary along its length or the thickness of the ramp 170 can be substantially uniform along its length.

Another attachment feature is in the form of a plurality of ribs 180 formed along the inner surface 150 of the body 110. The ribs 180 are formed between the bottom ramp edge 174 and the bottom edge of the body 110. In the illustrated embodiment, the complete width of the ribs 180 is about equal to or less than the width of the ramp 170 and thus, also the width, W, of the opening 130, so as to create an alignment between the opening 130, the ramp 170 and the ribs 180 such that an object that is inserted into the opening 130 and directed downward through the interior 140 comes into contact with the ramp 170 and the ribs 180. The ribs 180 are arranged parallel to each other and are formed along axes that are substantially perpendicular to the bottom edge of the side wall 112, 114. The length of the ribs 180 is such that the lower ends of the ribs 180 do not extend completely to the bottom edge of the side wall 112, 114.

The number of ribs 180 can vary, with the illustrated embodiment having six ribs 180. Likewise, the relative dimensions of each rib 180 can vary depending upon the precise application and depending upon the number of ribs 180 so long as the total width of the ribs 180 is equal to or less than the width of the ramp 170.

The thickness of the ribs 180 can either be substantially the same as the thickness of the ramp 170, especially at its bottom ramp edge 174, or the thickness can be less than or greater than the thickness of the ramp 170.

The ribs 180 serve several functions that are associated with the action of securing the top sizer clip 100 to the base section 70. First, the ribs 180 create friction so that the top sizer clip 100 stays on tight and second, the ribs 180 also prevent the sizer clip 100 from moving side to side as well.

In yet another aspect of the present invention, one or more of the side walls 112, 114 has a concave shape. This concave shape causes the central region or section of the wall 112, 114 to be the most inward section of the side wall with respect to the ends of the side wall 112, 114 that join the end walls 116, 118. Within this center region, the ramp 170 and the ribs 180 are formed, thereby causing the distance between the ramp 170/ribs 180 of one wall and those associated with the other wall to be less than the distance between the outer end regions of the walls 112, 114 proximate where the end walls 116, 118 are joined. This type of "bowed" construction for the side walls 112, 114 facilitates the frictional engagement between the base structure 70 and the clip 100.

In one embodiment, each of the side walls 112, 114 has a concave shape in that the outer surface of the side wall 112, 114 has a concave shape. The concave shape (curved face) construction for the clip 100 permits the sizer clip 100 to fit on many, if not most, of the existing hangers that are commercially available, including those with thinner and thicker base structures 70.

According to one embodiment, the ribs 180 on the inner surface 150 of one side wall 112, 114 are longitudinally offset from the ribs 180 on the inner surface 150 of the other opposing side wall 114, 112. According to another embodiment, the ribs 180 on the inner surface 150 of one side wall 112, 114 are longitudinally aligned and spaced across from the ribs 180 on the inner surface 150 of the other opposing sidewall 114, 112.

The process of securely attaching the top sizer clip 100 to the hanger 10 and more particularly, the hook member 20, is now described. The top sizer clip 100 is first aligned relative to the hanger 10 such that the bottom edge of the clip 100 and the interior 140 face the hook member 20. The free end of the hook member 20 is inserted into the interior 140 and is then is inserted into and through the opening 130 to permit the top sizer clip 100 to be fed along the length of the hook member 20 toward the upper edge 13 of the body portion 12. The shape and dimensions of the interior 140 are selected so as to permit the reception of the base structure 70 therein so as to permit the top sizer clip 100 to be disposed about the base structure 70, with the bottom edge of the clip 100 being disposed proximate to the upper edge 13 of the body portion 12 (as well as being substantially parallel thereto).

The attachment features 170, 180 are orientated so that as the top sizer clip 100 is directed over the base structure 70, the circular base structure 70 first comes into contact with the ribs 180 which creates friction between the top sizer clip 100 and the hanger 10. This results in an interference fit (mechanical or frictional fit) being formed between the base structure 70 and the top sizer clip 100 which facilitates the coupling between the top sizer clip 100 and the hanger 10. It will also be appreciated that the dimensions, e.g., diameter, of the base structure 70 is preferably greater than a depth of the top sizer clip 100, as measured between the two side walls 112, 114 at the bottom edge thereof, and therefore, as the base structure 70 is inserted into the interior 140, the base structure 70 causes the side walls 112, 114 to separate from one another. This is especially the case when the base structure 70 contacts the ribs 180.

As the top sizer clip 100 is directed further toward the upper edge 13, the base structure 70 next comes into contact with the ramp 170 after the base structure 70 travels along the full length of the ribs 180. As previously mentioned, the similar or same thickness of the ribs 180 and the ramp 170 at least at an interface thereof permits the easy transition of the base structure 70 and the ramp 170 as the clip 100 travels over the base structure 70.

In addition, the notches 135 that are formed along end edges 132 that define the opening 130 are for flexing/stretching so that the top sizer clip 100 can fit over even thicker hangers/hook holders (hook member 20). In particular, the notches 135 introduce weak points in the top wall of the top sizer clip 100 and permit the wall structures of the top sizer clip 100 to flex as the base structure is inserted into the interior 140 and causes the walls 112, 114 to flex outwardly. As previously mentioned, the opening 130 is sized so that the base structure 70 (at least an upper section thereof) can fit into and extend through the opening 130.

Because of the general resilient nature of the top sizer clip 100, especially, the side walls 112, 114, once the clip 100 is removed from the base structure 70, the side walls 112, 114 may resume, as least in part, their concave shape. However, it will be appreciated that this may not be the case for all top sizer clips 100 and in all uses or applications for the top sizer clip 100, especially when thicker base structures 70 are present and/or when the top sizer clip 100 is secured to the base structure 70 over an extended period of time. Thus, the top sizer clip 100 can be intended for more of a one-time use in that the concave nature of the walls 112, 114 may be permanently deformed as a result of some uses and therefore will not resume its original shape. However, it may be possible for the top sizer clip 100 to be used again even if it is partially deformed and no longer has a distinct concave shape for the walls 112, 114.

The top sizer clip 100 is directed down over the base structure 70 until the clip 100 is securely attached to the base structure 70 and typically, the top sizer clip 100 is inserted until its bottom edge contacts or is close to the upper edge 13 of the body portion 12 of the hanger 10.

The design (e.g., concave shape) of the top sizer clip 100 and the features (e.g., ribs 180 and ramp 170) incorporated therein provide a clip 100 that can be used with a vast number of different styles and types of hangers 10 without any need to retrofit or modify the structure. Conventional top sizer clips are most times custom designed for a specific type or style of hanger (i.e., a matching hanger) and therefore, when they are used with other hangers, the clips tend not to be secured to the hanger but instead either are too small so that they can not be received on the base structure or they are too large and therefore, they wobble on the base structure and can easily be disengaged and fall off from the hanger.

While exemplary drawings and specific embodiments of the present invention have been described and illustrated, it is to be understood that the scope of the present invention is not to be limited to the particular embodiments discussed. Thus, the embodiments shall be regarded as illustrative rather than restrictive, and it should be understood that variations may be made in those embodiments by workers skilled in the art without departing from the scope of the present invention as set forth in the claims that follow, and equivalents thereof. In addition, the features of the different claims set forth below may be combined in various ways in further accordance with the present invention.

What is claimed is:

1. A top sizer clip for use with a garment hanger comprising:

a body having a pair of side walls and end walls joined to and extending between the side walls, wherein each the side walls has a concave shape, the body including a top wall that is joined to upper edges of the side walls and end walls, the top wall partially enclosing the body so as to create a hollow body structure that includes an interior compartment defined by the end walls, side walls, and top wall, and wherein a length of the side wall is greater than a length of the end wall, the length being the distance of one edge of side wall that intersects one end wall to the other edge of the side wall that intersects the other end wall, wherein each of the side walls has a concave outer surface and an opposite convex inner surface that faces the interior compartment and contacts the hanger when clip is used with the hanger.

2. The top sizer clip of claim 1, wherein the top wall includes an opening formed therethrough for receiving a hook member of the hanger and one or more first features formed therein to accommodate flexing of the body when it is inserted over the hook member.

3. top sizer clip of claim 2, wherein the first feature comprises a notch formed along a peripheral edge that defines the opening in the top wall, the notch and opening being in communication with one another.

4. The top sizer clip of claim 3, wherein a pair of notches are formed in end edges that define the opening in the top wall.

5. The top sizer clip of claim 1, wherein the concave shaped side wall has a trapezoidal shape.

6. The top sizer clip of claim 1, wherein each of the first and second side walls has a concave shape.

7. A top sizer clip for use with a garment hanger comprising:

a body having a pair of side walls and end walls joined to and extending between the side walls, wherein each of the side walls has a concave shape, the body including a top wall that is joined to upper edges of the side walls and end walls, the top wall partially enclosing the body so as to create a hollow body structure that includes an interior compartment defined by the end walls, side walls, and top wall, wherein an inner surface of at least one of the first and second side walls includes a friction enhancing feature, wherein each of the side walls has a concave outer surface and an opposite convex inner surface that faces the interior compartment and contacts the hanger when the clip is used with the hanger, the friction enhancing feature being formed on a most inward section of the convex inner surface.

8. The top sizer clip of claim 7, wherein the friction enhancing feature comprises a plurality of ribs that are vertically orientated along the side wall.

9. The top sizer clip of claim 8, wherein the friction engaging feature includes a raised ramp that is formed along the inner surface of the side wall adjacent the plurality of ribs so as to form a transition interface between an opening formed in the body, for receiving a hook member of the hanger, and the ribs.

10. The top sizer clip of claim 9, wherein the opening is formed in a top wall that is joined to upper edges of the side walls and the end walls, one end of the ramp being in communication with the opening in the top wall such that the hook member introduced into an interior of the body engages the ramp and travels thereover.

11. The top sizer clip of claim 9, wherein a width of the ramp is substantially equal to a length of the opening.

12. The top sizer clip of claim 9, wherein a thickness of the ribs is less than or equal to a thickness of the ramp.

13. The top sizer clip of claim 9, wherein the ramp and ribs are formed in a central section of the side wall.

14. The top sizer clip of claim 8, wherein the ribs comprise a plurality of spaced apart fingers that are formed integrally to one end of the ramp, the ribs terminating prior to a bottom edge of the side wall of the body.

15. A top sizer clip for use with a garment hanger having a cross bar with hook members at ends thereof comprising:

a body having a pair of side walls, a top wall, and end walls joined to and extending between the side walls, wherein each of the side walls has a concave shape, the top wall being joined to upper edges of the side walls and end walls to partially enclose the body so as to create a hollow structure that includes an interior compartment defined by the end walls, side walls, and top wall, the top wall having an opening formed therein to provide an entrance into the interior compartment and for receiving the hook member of the hanger, wherein an inner surface of at least one of the first and second side walls includes a friction enhancing feature in the form of a plurality of ribs that are vertically orientated along the inner surface of the side wall and axially aligned with the opening, the side walls of the body being parallel to sides of the cross bar and the end walls of the body being perpendicular to the side walls of the cross bar, wherein each of the side walls has a concave outer surface and an opposite convex inner surface that faces the interior compartment and contacts the hanger when the clip is used with the hanger, the friction enhancing feature being formed on a most inward section of the convex inner surface.

16. The top sizer clip of claim 15, wherein the friction engaging feature further includes a raised ramp that is formed along the inner surface of the side wall adjacent the plurality of ribs so as to form a transition interface between the opening formed in the top wall and the ribs.

17. The top sizer clip of claim 16, wherein one end of the ramp is in communication with the opening in the top wall such that the hook member introduced into the opening engages the ramp and slides thereover.

18. top sizer clip of claim 16, wherein a width of the ramp is substantially equal to a length of the opening.

19. The top sizer clip of claim 16, wherein a thickness of the ribs is less than or equal to a thickness of the ramp.

20. The top sizer clip of claim 16, wherein the ribs on the inner surface of one side wall are longitudinally aligned and spaced across from the ribs on the inner surface of the other opposing side wall.

21. The top sizer clip of claim 15, wherein the top wall includes an opening formed therethrough for receiving the hook member and one or more first features formed therein to accommodate flexing of the body when it is inserted over the hook member.

22. The top sizer clip of claim 21, wherein the first feature comprises a notch formed along a peripheral edge that defines the opening in the top wall, the notch and opening being in communication with one another.

23. The top sizer clip of claim 22, wherein a pair of notches are formed in end edges that define the opening in the top wall.

24. The top sizer clip of claim 15, wherein the ribs on the inner surface of one side wall are longitudinally offset from the ribs on the inner surface of the other opposing side wall.

25. A top sizer clip for use with a garment hanger comprising:

a body having a pair of side walls and end walls joined to and extending between the side walls, wherein each the side walls has a concave shape, the body including a top wall that is joined to upper edges of the side walls and end walls, the top wall partially enclosing the body so as to create a hollow body structure that includes an interior compartment defined by the end walls, side walls, and top wall, and wherein a length of the side wall is greater than a length of the end wall, wherein an inner surface of at least one of the first and second side walls includes a friction enhancing feature in the form of a plurality of ribs that are vertically orientated along the side wall and a raised ramp that is formed along the inner surface of the side wall adjacent the plurality of spaced apart vertical ribs so as to form a transition interface between an opening formed in the body, for receiving a hook member of the hanger, and the ribs, the ribs being integrally connected at an upper ends to the ramp, while lower ends thereof terminate prior to a bottom edge of the side wall, wherein each of the side walls has a concave outer surface and an opposite convex inner surface that faces the interior compartment and contacts the hanger when the clip is used with the hanger, the friction enhancing feature being formed on a most inward section of the convex inner surface.

* * * * *